US006148921A

United States Patent [19]

Valla et al.

[11] Patent Number: 6,148,921

[45] Date of Patent: Nov. 21, 2000

[54] OIL EXTRACTING INSTALLATION INCORPORATING MANIFOLD SUPPORT MOUNTING PLATES, AND PLATE

[75] Inventors: Hervé Jean Albert Marcel Valla, Paris; Pierre Henri Vasseur, Tremblay, both of France

[73] Assignee: Coflexip, France

[21] Appl. No.: 09/180,142

[22] PCT Filed: Apr. 30, 1997

[86] PCT No.: PCT/FR97/00775

§ 371 Date: Nov. 3, 1999

§ 102(e) Date: Nov. 3, 1999

[87] PCT Pub. No.: WO97/42396

PCT Pub. Date: Nov. 13, 1997

[30] Foreign Application Priority Data

May 3, 1996 [FR] France ..... 96 05586

[51] Int. Cl.[7] ..... E21B 7/12

[52] U.S. Cl. ..... 166/344; 166/170; 166/338

[58] Field of Search ..... 166/384, 383, 166/315, 70, 338–344; 137/242

[56] References Cited

U.S. PATENT DOCUMENTS

| | | | |
|---|---|---|---|
| 3,346,045 | 10/1967 | Knapp et al. | 166/384 X |
| 3,444,927 | 5/1969 | Childers et al. | 166/383 X |
| 3,525,401 | 8/1970 | Hanson et al. | 166/315 |
| 3,637,012 | 1/1972 | Sizer et al. | 166/383 X |
| 3,674,123 | 7/1972 | Lewis et al. | 166/70 X |
| 4,023,619 | 5/1977 | Marquaire et al. . | |
| 4,102,146 | 7/1978 | Dietrich . | |
| 4,525,101 | 6/1985 | Stevens et al. | 405/185 X |
| 4,574,930 | 3/1986 | Rickey et al. | 137/242 |
| 4,614,459 | 9/1986 | Labbe et al. | 405/170 |
| 4,616,706 | 10/1986 | Juffaker et al. | 166/70 X |
| 5,040,603 | 8/1991 | Baldridge | 166/70 X |
| 5,435,338 | 7/1995 | Da Silva et al. | 137/242 |
| 5,437,302 | 8/1995 | Da Silva et al. | 137/242 |

*Primary Examiner*—Dennis L. Taylor
*Attorney, Agent, or Firm*—Ostrolenk, Faber, Gerb & Soffen, LLP

[57] ABSTRACT

The invention features an offshore oil installation (1) comprising two mounting plates (6, 8) resting on the ocean bed, each mounting plate (6, 8) supporting a manifold (10; 10') connected at two ends with two respective terminal joining pieces of flexible pipe section (5, 7; 7, 9) fixed to the manifold (10; 10') substantially in the extension of each other, each manifold (10; 10') further comprising a flange for sealed joining with a pipe (12) coming from an underwater structure such as a wellhead (2; 3), the manifold (10; 10') of the two supporting plates (6; 8) being interconnected at one end by a flexible pipe section (7) and connected at the other end by two respective pipe sections (5, 9) to a surface extracting installation (4).

17 Claims, 17 Drawing Sheets

OIL EXTRACTING INSTALLATION INCORPORATING MANIFOLD SUPPORT MOUNTING PLATES, AND PLATE

BACKGROUND OF THE INVENTION

The present invention relates to offshore oil extraction and, more particularly, to an oil extracting installation employing flexible pipes for transporting fluids under pressure, such as hydrocarbons, coming from underwater wellheads.

The pipes employed for transporting hydrocarbons may become soiled and clogged due to the formation of a deposit on the inner surface of the pipes, which happens frequently when the hydrocarbons have a high paraffin content.

In this case, cleaning of the pipes, also called "pigging", may be carried out periodically by exerting mechanical action on the inner surface of the pipes.

In order to conduct this cleaning operation, the underwater wellheads are isolated from the flexible pipe sections serving for transporting the hydrocarbons up to the surface, and these flexible pipe sections are connected to one another so as to form a loop which makes it possible, from a surface extracting installation, to inject a cleaning device at one end of the loop and to recover this cleaning device at the other end of the loop.

In order to make it possible to isolate the underwater wellheads more easily from the flexible pipe sections serving for transporting the hydrocarbons up to the surface, it is known for the connecting manifolds, allowing a sealed connection to be made between the pipes of short length and small diameter coming from the wellheads and the flexible pipe sections of great length and larger diameter serving for transport up to the surface, to be arranged on mounting plates resting on the ocean bed.

Using such mounting plates makes it easier to connect the pipes of different diameters, for example make the connection between a flexible pipe having an inside diameter of 6" and a pipe having an inside diameter of 4", inasmuch as it would be difficult for a manifold to be incorporated for this purpose on the wellhead itself in view of its structure.

Moreover, these mounting plates may support the valves which make it possible to isolate the wellheads and put the various flexible pipe sections in communication with one another in order to form the loop necessary for the cleaning operation.

In order, during the cleaning operation, to connect two flexible pipe sections employed during extraction for conveying the hydrocarbons from the respective wellheads up to the surface extracting installation, it has been proposed to use a mounting plate supporting a rigid U-shaped union connected at its ends to two flexible pipe sections.

The U-union is isolated by means of a valve during extraction from the well, so that the hydrocarbons produced by each of the wellheads pass through two separate flexible pipe sections up to the surface extracting installation; for cleaning to be carried out, each wellhead is isolated and the two flexible pipe sections are put in communication by means of the U-union, thus making it possible to form a loop allowing a cleaning device to pass through the two flexible pipe sections.

However, the use of a mounting plate supporting a U-union connected to two juxtaposed flexible pipe sections makes the installation difficult and costly to install, inasmuch as one of the two flexible pipe sections is connected to a second mounting plate which has to be put under water while the unwinding of the two flexible pipe sections by chain is being carried out at the same time.

A second solution would involve placing the mounting plates on the bed and connecting the flexible pipes to the manifolds in situ.

However, such a solution is not easy to put into practice, inasmuch as it is difficult for elements to be assembled to be displaced horizontally on the ocean bed.

SUMMARY OF THE INVENTION

The object of the invention is, in particular, to make it easier to install an oil extracting installation comprising mounting plates for supporting a manifold connected to flexible pipe sections.

According to one characteristic of the invention, the oil extracting installation comprises two mounting plates resting on the ocean bed. Each mounting plate supports a manifold connected at two ends to two respective terminal joining pieces of flexible pipe sections fixed to the manifold substantially in the extension of one another. Each manifold comprises, furthermore, a flange for sealed connection to a pipe coming from an underwater structure, such as an underwater wellhead. The manifolds of the two mounting plates are connected to one another at one end by means of a flexible pipe section and are connected at the other end to a surface extracting installation by means of respective flexible pipe sections.

It must be appreciated that the terminal joining pieces of flexible pipe sections are fixed to the manifold substantially in the extension of one another when the flexible pipe sections leave the mounting plate, to which the said manifold is fixed, in substantially opposite directions.

The oil exploiting installation can then be installed on the ocean bed, without the need to put two flexible pipes into the water simultaneously, since it is possible, by virtue of the invention, to begin by putting a first flexible pipe section into the water and subsequently put a first mounting plate into the water, then a second flexible pipe section, a second mounting plate and, finally, a third flexible pipe section.

Advantageously, those portions of the flexible pipes which are near the terminal joining pieces fixed to the manifold can each slide in a curvature limiting member integral with the said mounting plate.

In a particular exemplary embodiment of the invention, the said curvature limiting member consists of an assembly of vertebrae which is fixed at one end to the said mounting plate and inside which the said flexible pipe portion near the terminal joining piece fixed to the manifold can slide.

Advantageously, the said manifolds are each generally T-shaped, the said flange for connection to the pipe coming from the associated underwater structure being carried by the central branch of the T.

Advantageously, one of the two mounting plates supports a valve making it possible to put in communication or isolate the manifolds located on the two mounting plates.

Advantageously, the installation comprises a network of lines for the remote control of underwater members, such as valves, this network consisting of pipes of the umbilical type and comprising a first umbilical connecting the surface extracting installation to a first mounting plate and a second umbilical connecting the first mounting plate to the second mounting plate.

Another object of the invention is to provide a method for installing an oil extracting installation, this installation comprising two mounting plates intended for resting on the ocean bed, each mounting plate supporting a manifold intended to be connected at two ends to two respective flexible pipe sections fixed to the manifold substantially in the extension of one another, each manifold comprising, furthermore, a flange for sealed connection to a pipe coming from an underwater structure, such as a wellhead, the manifolds being intended to be connected to one another at one end by means of a flexible pipe section and at the other end to a surface extracting installation by means of respective flexible pipe sections, this method comprising the steps involving in succession, unwinding, from a starting point, a first flexible pipe section onto the ocean bed by means of an installation ship, putting into the water a first mounting plate, previously connected to the first section and to a second section, whilst at the same time unwinding the start of the second section and the end of the first, unwinding the said second flexible pipe section onto the bed, putting into the water the second mounting plate, previously connected to the second section and to a third section, whilst at the same time unwinding the start of the third section and the end of the second, unwinding the said third flexible pipe section onto the bed, the installation ship substantially executing a loop between the said starting point and an arrival point during the installation of the three flexible pipe sections.

Advantageously, each mounting plate is put into the water when the mounting plate is connected to the installation ship by means of two cables, a first cable being attached to the rear of the mounting plate and a second cable being attached to a rigid gantry articulated on the mounting plate, only the cable connected to the rear of the mounting plate serving for supporting the mounting plate in a first stage of the descent, the tension in this cable being relaxed when the mounting plate reaches a particular depth, the cable attached to the gantry then serving for bringing the mounting plate into a substantially horizontal position and subsequently for retaining it until it is installed on the ocean bed.

Advantageously, the gantry is fixed removably to the mounting plate so as to be capable of being recovered after the installation of a mounting plate and of serving for installing the next mounting plate.

Advantageously, the gantry comprises at least one rotary actuation member intended to be actuated by a handling robot, this rotary actuation member being connected by means of a transmission to a mechanism capable of converting the rotation of the said member into a movement for unlocking a hook fixing the gantry to the mounting plate.

Moreover, it has been proposed to make the connection between the underwater wellhead and the flange connecting the manifold carried by the mounting plate by means of a rigid pipe made to measure after in-situ observation of the orientations of the said connecting flange and of a second connecting flange provided on the wellhead and of their relative position.

This procedure is relatively lengthy and costly.

In order to make it easier to make the connection between an underwater structure, such as an underwater wellhead, and the connecting flange provided on the manifold carried by the mounting plate, according to the invention a new manifold support mounting plate is proposed for an oil extracting installation.

This new mounting plate is intended for resting on the ocean bed and supports a manifold for making a sealed connection between a pipe coming from an underwater structure, such as an underwater wellhead, and at least one terminal part of at least one flexible pipe section, the manifold comprising a flange for connection to the said pipe, and the mounting plate and/or the manifold comprising means for orienting the axis of the connecting flange in a selected direction, before the connection to the said pipe is made, when the mounting plate rests on the ocean bed.

Such a mounting plate makes it easy to install a pipe between the manifold provided on the mounting plate and the wellhead, inasmuch as it is no longer necessary to make a pipe to measure, and, furthermore, such a mounting plate makes it possible to install the installation on an ocean bed having pronounced relief variations, whilst at the same times using pipes equipped with unions comprising a locking member capable of coming into a locking position as a result of the effect of gravity, in which case the said abovementioned selected direction corresponds to the vertical, with an angular tolerance less than or equal to 10°, preferably less than or equal to 5°.

In a particular embodiment, the mounting plate comprises a fixed frame, intended for resting on the ocean bed, and a platform which is orientable relative to the frame and to which the said manifold is fixed.

In a particular embodiment, the said platform is connected to the said frame by means of a cardan-type joint.

Advantageously, the mounting plate comprises means making it possible for the said connecting flange to be oriented and maintained in the selected position.

Advantageously, the mounting plate comprises, furthermore, means making it possible for a gantry used for the installation and/or recovery of the mounting plate to be fixed removably to the mounting plate.

Other characteristics and advantages of the present invention will emerge on reading the following detailed description of a non-limiting exemplary embodiment of the invention and from an examination of the accompanying drawing in which:

DESCRIPTION OF A PREFERRED EMBODIMENT

Figure 1:
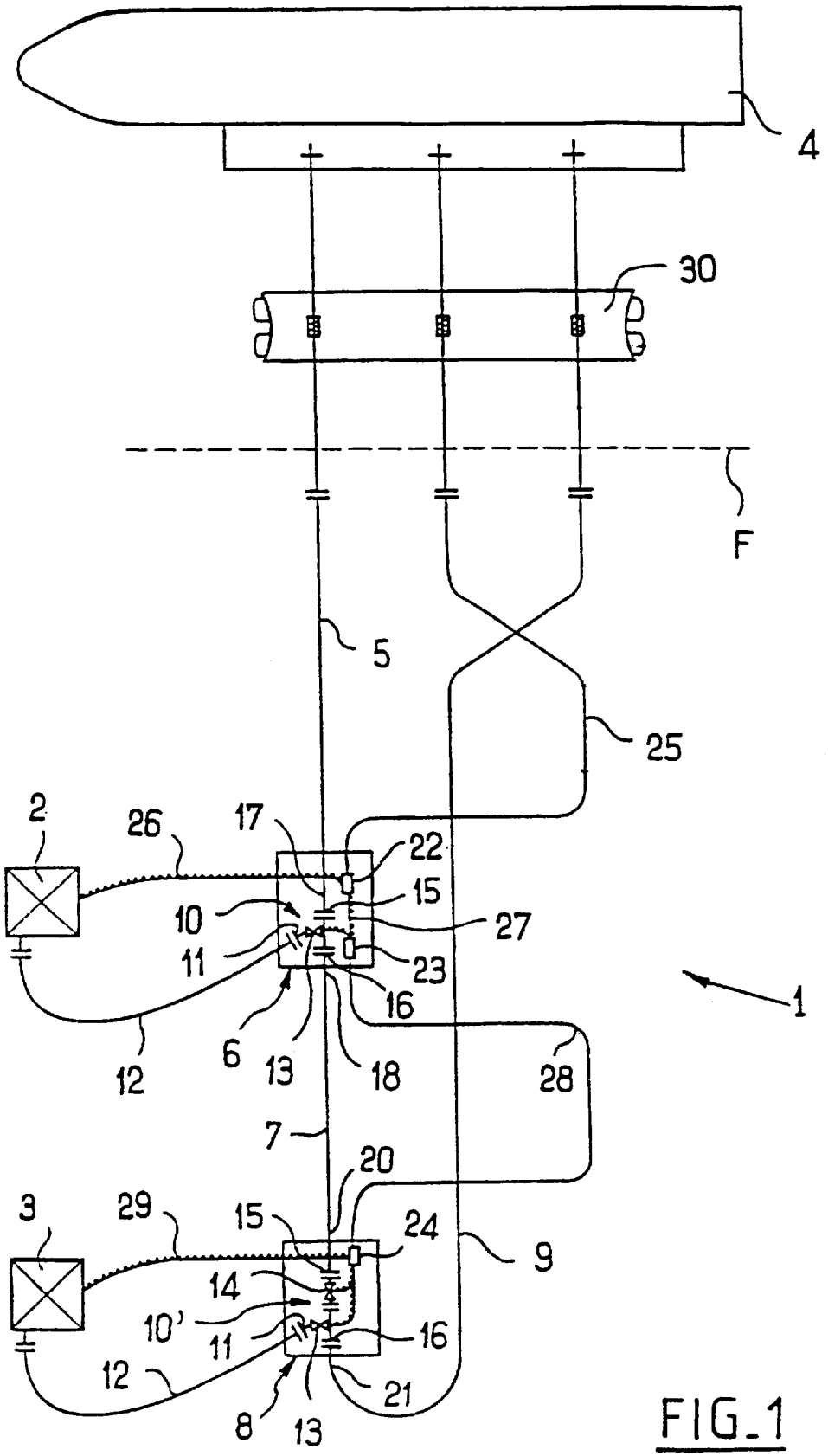
FIG. 1 is a diagrammatic top view of an oil extracting installation according to one exemplary embodiment of the invention.

FIG. 1 illustrates diagrammatically an installation 1 according to a particular exemplary embodiment of the invention.

This installation 1 is intended for working two underwater oil wellheads 2, 3 from a surface building 4, such as a dynamically positioned ship.

In the example described, the difference in depth between the underwater well 2 and the underwater well 3 is of the order of 150 m, the average gradient between the two wells being of the order of 7°.

The installation 1 comprises a first flexible pipe section 5 for connecting the ship 4 to a manifold 10 supported by a first mounting plate 6. This manifold connects the underwater wellhead 2 to the first flexible pipe section 5.

A second flexible pipe section 7 connects the manifold 10 to a second manifold 10' located on a second mounting plate 8.

A third flexible pipe section 9 connects the manifold 10' located on the second mounting plate 8 and the ship 4.

In the exemplary embodiment described, the flexible pipe sections 5, 7 and 9 have an inside diameter of 6" and are of the "flow-line" type.

Each manifold 10, 10' comprises a T-union, this union carrying, on its central branch, a flange 11 for sealed connection to a pipe 12 which comes from the wellhead 2, 3 associated with the mounting plate in question in the example described, the pipe consists of a flexible pipe having an inside diameter of 4", this pipe 12 also being called a "jumper".

Each T-union is equipped, on its branch carrying the flange 11, with a valve 13 making it possible to isolate the pipe 12 for an operation to clean the pipe sections 5, 7 and 9, as will be described in more detail later.

The manifold 10' supported by the mounting plate 8 comprises, furthermore, a valve 14 making it possible to isolate the T-union from the flexible pipe section 7 during extraction from the wellheads 2 and 3.

It will be seen that the opposite connecting flanges of each manifold 15 and 16 have substantially parallel axes, thus making it possible for the respective terminal portions 17 and 18 of the flexible pipe sections 5 and 7 to be located substantially in the extension of one another.

The mounting plates 6 and 8 also support connecting housings for control umbilicals.

The expression "control umbilical" is intended to mean one or more cables for the transport of information, electrical energy or hydraulic energy.

More specifically, the mounting plate 6 supports two connecting housings 22, 23 and the mounting plate 8 supports one connecting housing 24.

The connecting housing 22 makes it possible to connect a control umbilical 25 coming from the ship 4, a control umbilical 26 connected to the wellhead 2 and a control umbilical 27 connected to the connecting housing 23. The latter makes it possible to connect the control umbilical 27 and one end of a control umbilical 28 which is connected at the other end to the connecting housing 24. The connecting housing 23 is likewise connected by the control umbilical to the valve 13 for the purpose of controlling the opening or closing of the latter. The connecting housing 24 makes it possible to connect the control umbilical 28, a control umbilical 29 coming from the wellhead 3 and two control umbilicals respectively connected to the valves 13, 14 for controlling the opening or closing of the latter.

The control umbilical 27 is fixed permanently to the mounting plate 6, and it is installed on the ocean bed at the same time as the latter.

In FIG. 1, the entire part extending above the broken line F rests on the ocean bed, whilst the part located underneath extends between the ocean bed and the ship 4.

An arch 30 is placed in the path of the flexible pipe sections extending between the ship 4 and the ocean bed, the flexible pipe sections resting on this arch 30 in a configuration known per se and of the "lazy-S" type.

The flexible pipe sections 5 and 9 consist, on their portion extending between the ocean bed and the ship 4, of flexible pipes specially designed for raising hydrocarbons and of the "riser" type.

During the working of the wellheads 2, 3, the valves 13 are open and the valve 14 is closed.

The hydrocarbons under pressure which come from the wellhead 2 are conveyed to the ship 4 by means of the flexible pipe section 5, whilst the hydrocarbons under pressure which come from the wellhead 3 are conveyed to the ship 4 by means of the flexible pipe section 9.

If the hydrocarbons produced are rich in paraffin, progressive clogging of the flexible pipe sections 5 and 9 occurs, thus making it necessary to carry out periodic cleaning of these.

For this purpose, the valves 13 are closed so as to isolate the wellheads 2 and 3 and the valve 14 is opened so as to connect the pipe sections 5, 7 and 9 and form a loop making it possible to inject a cleaning device from the ship 4 via one end of one of the sections 5 and 9.

The cleaning device may comprise, in a way known per se, a brush and/or any other scraping system.

Figure 2:
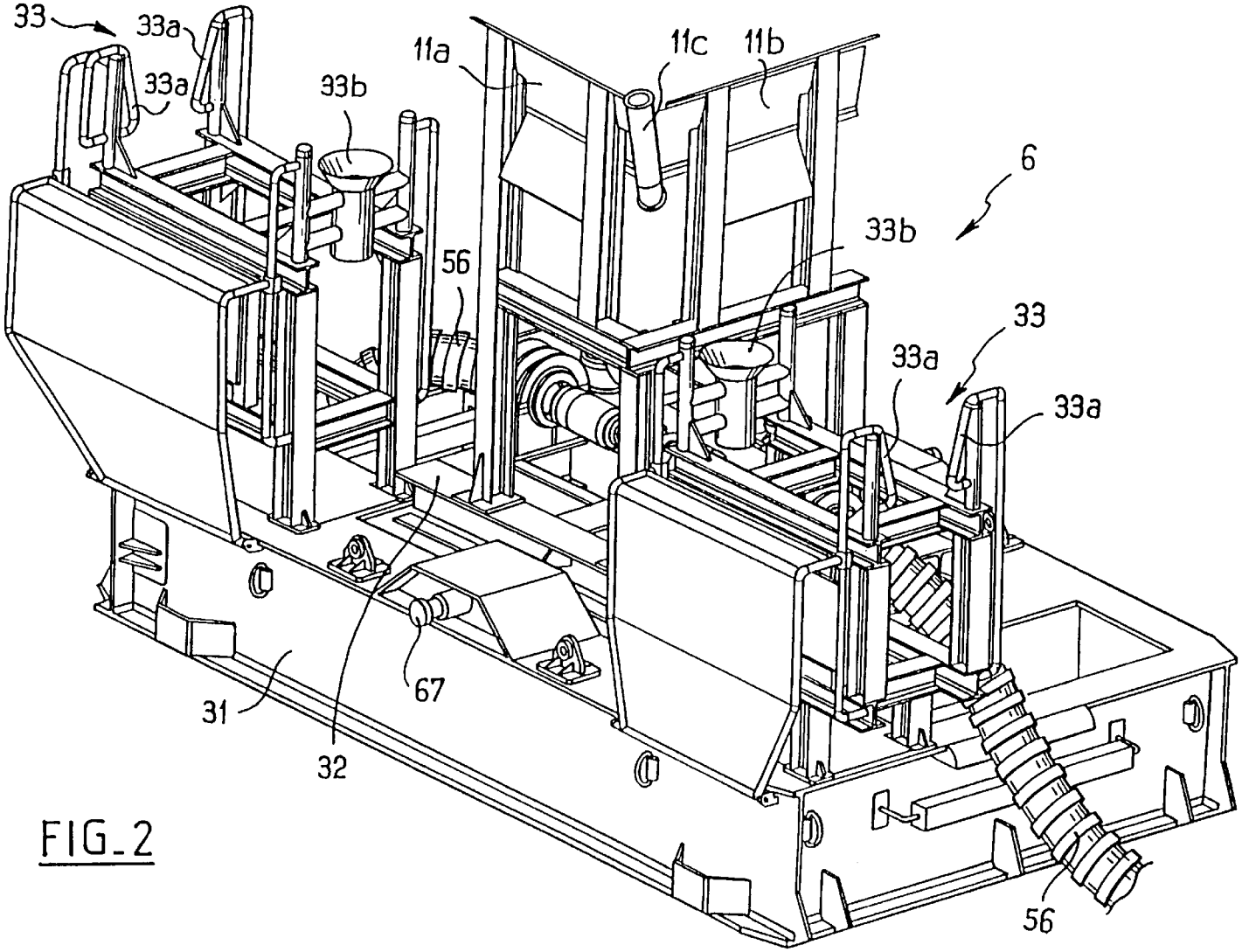
FIG. 2 is a diagrammatic perspective view of a mounting plate according to one exemplary embodiment of the invention.

FIG. 2 illustrates a diagrammatic perspective view of the mounting plate 6.

The mounting plate 8 is substantially identical to the mounting plate 6, except that it carries only one support of a connecting housing for control umbilicals and that it additionally carries the valve 14. The mounting plate 6 has not been illustrated in detail in the drawing.

The mounting plate 6 comprises a frame 31, produced from metal in the example described, and a platform 32 for supporting the manifold 10, this platform 32 advantageously being orientable in a selected position relative to the frame 31, as will be described in more detail later.

FIG. 2 shows two supports 33 intended for receiving the connecting housings 22 and 23. Each support 33 is equipped with guide rails 33*a* making it possible to center the connecting housing during its descent onto the support and with a guide 33*b* for introducing a spindle which extends the connecting housing downwards. The guide 33*b* has, in the upper part, a widened orifice making it easier to introduce the spindle.

The frame 31 has a generally flattened and rectangular shape.

Figure 3:
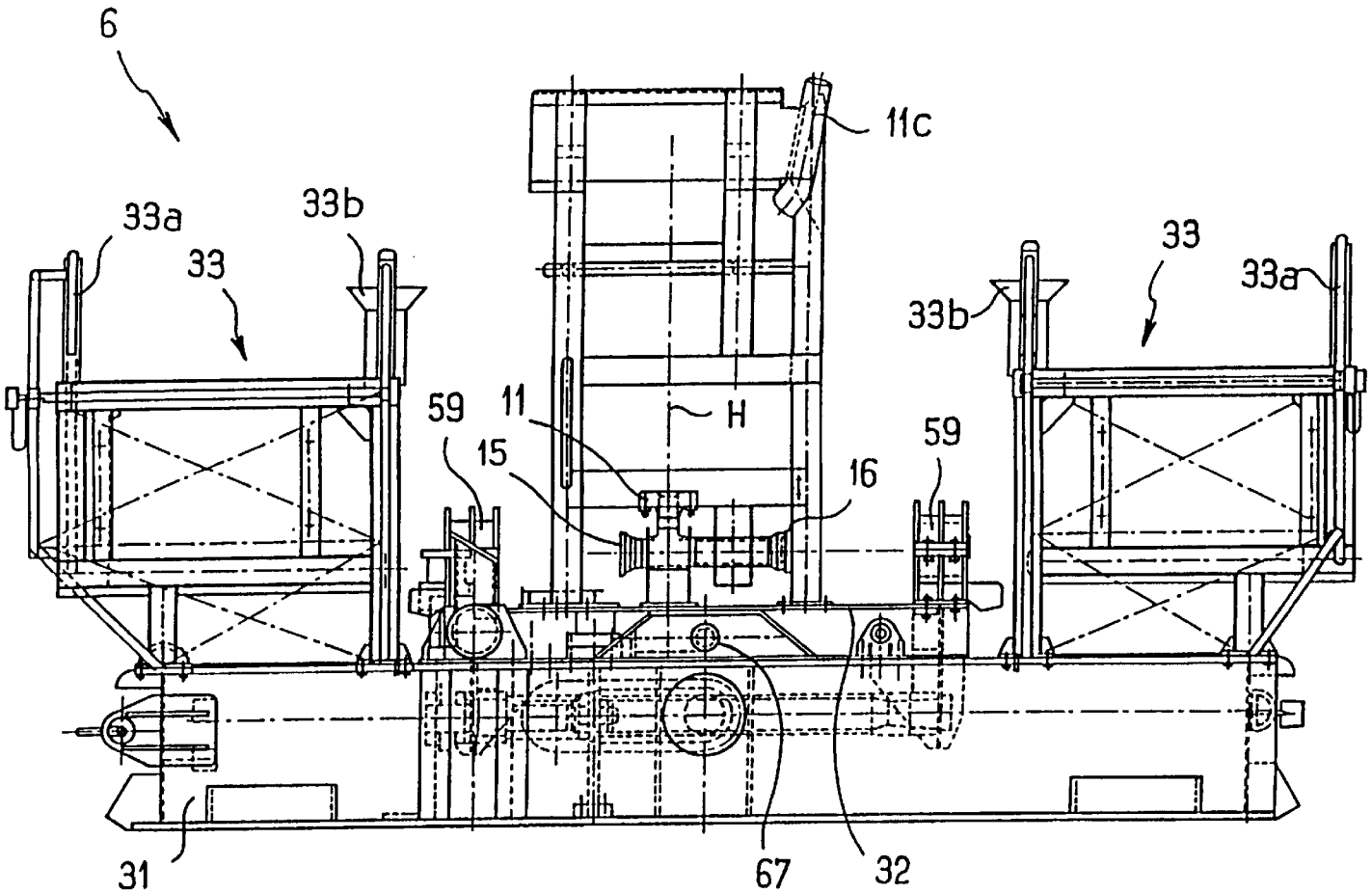
FIG. 3 is a side elevation view of the mounting plate illustrated in FIG. 2, the flexible pipes not being illustrated.

FIG. 3 illustrates a side elevation view of the mounting plate 6, the terminal portions of the flexible pipe sections not being illustrated in this figure.

Figure 4:
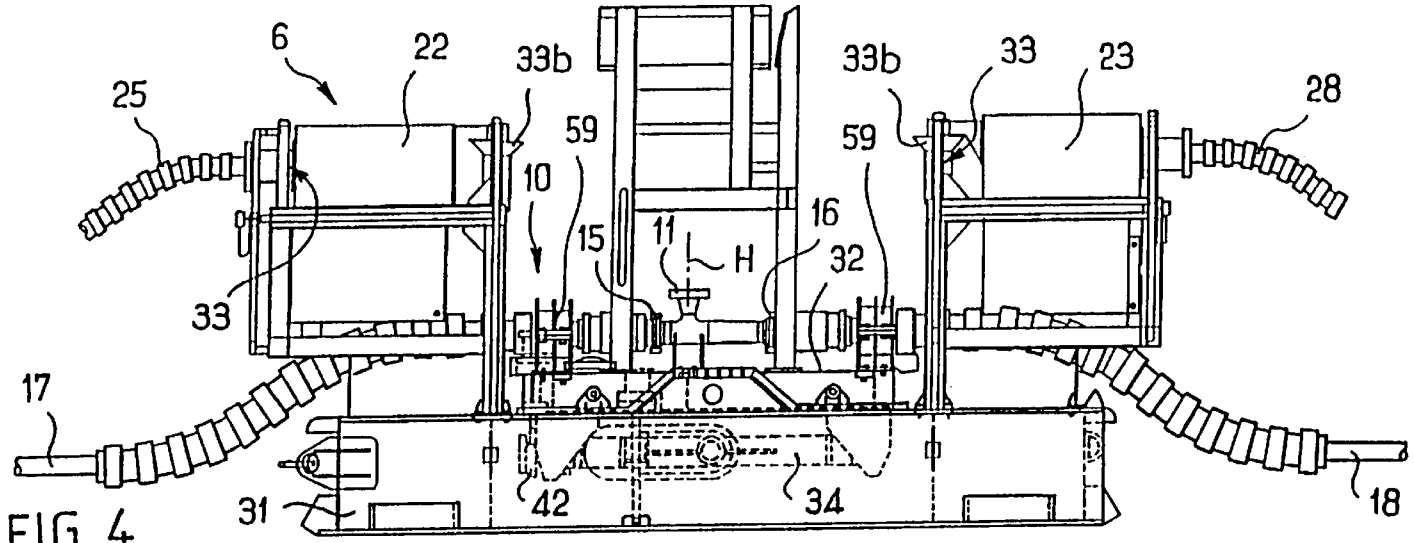
FIG. 4 is a view similar to that of FIG. 3, after the flexible pipes and the connecting housings of the control umbilicals have been installed.

FIG. 4 shows a side elevation view of the mounting plate 6 when the terminal portions 17 and 18 of the flexible pipe sections are fixed to the T-union of the manifold 10. The connecting housings 22 and 23 and the control umbilicals 25 and 28 are likewise illustrated highly diagrammatically in FIG. 4.

As mentioned above, the platform 32 is orientable relative to the frame 31. More specifically, in the exemplary embodiment described, the platform 32 is connected to the frame 31 by means of a cardan-type joint making it possible to oscillate the platform 32 about a first geometric axis of rotation X, substantially parallel to the side of largest dimension of the frame 31, and about a second geometric axis of rotation Y perpendicular to and secant with the axis X. The intersection of the axes X and Y corresponds substantially to the center of gravity of the platform, so that the position of the latter can be adjusted relatively easily.

Figure 7:
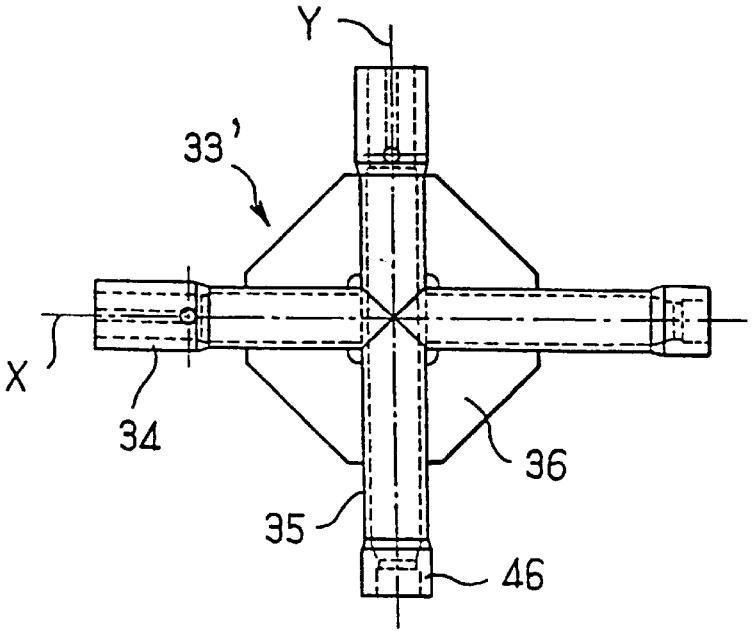
FIG. 7 shows, in isolation, an element of the joint making it possible for the platform illustrated in FIG. 6 to be oriented in a selected position.
Figure 8:
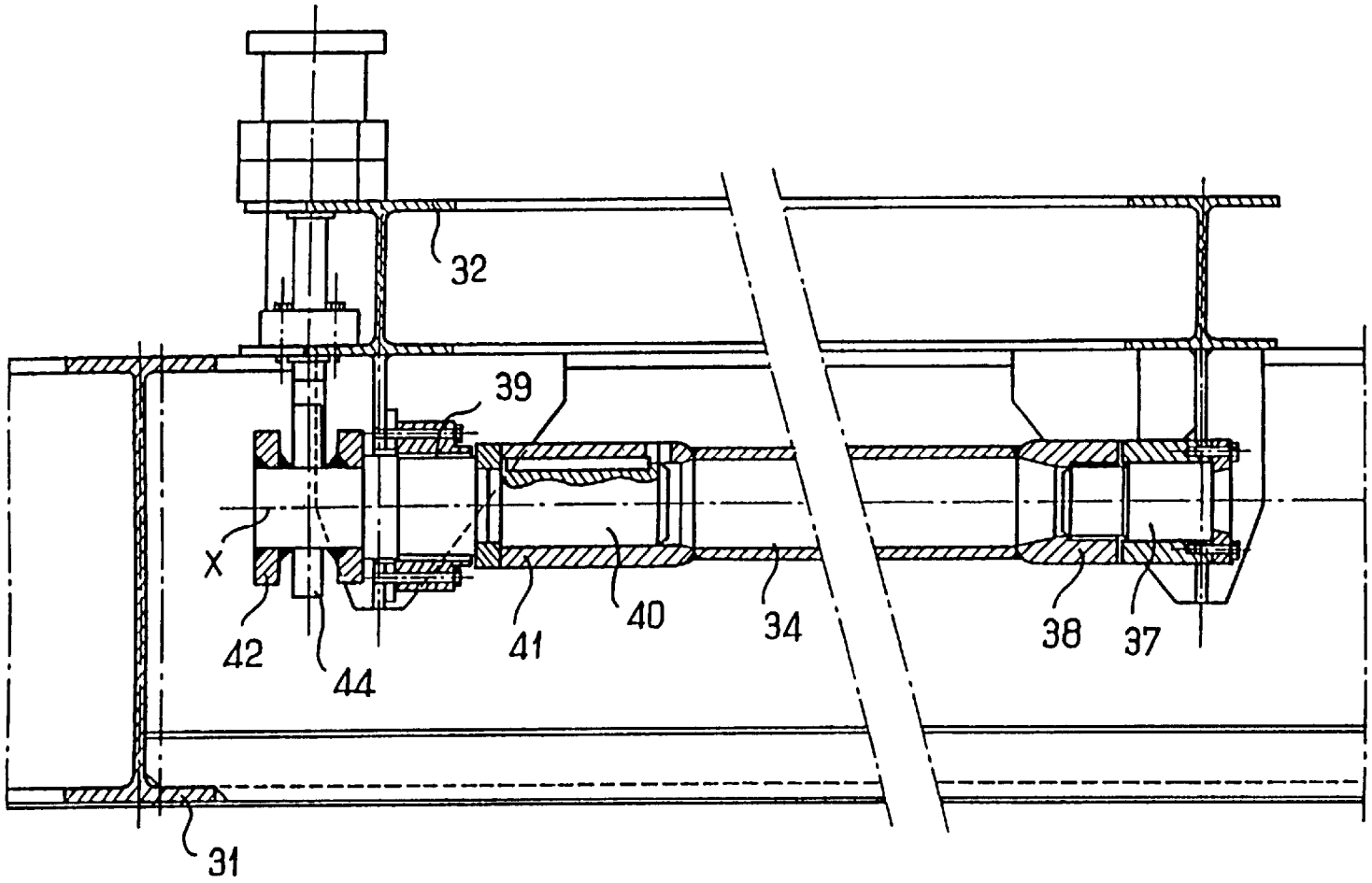
FIG. 8 is a sectional view along the sectional line VIII—VIII of FIG. 6.
Figure 9:
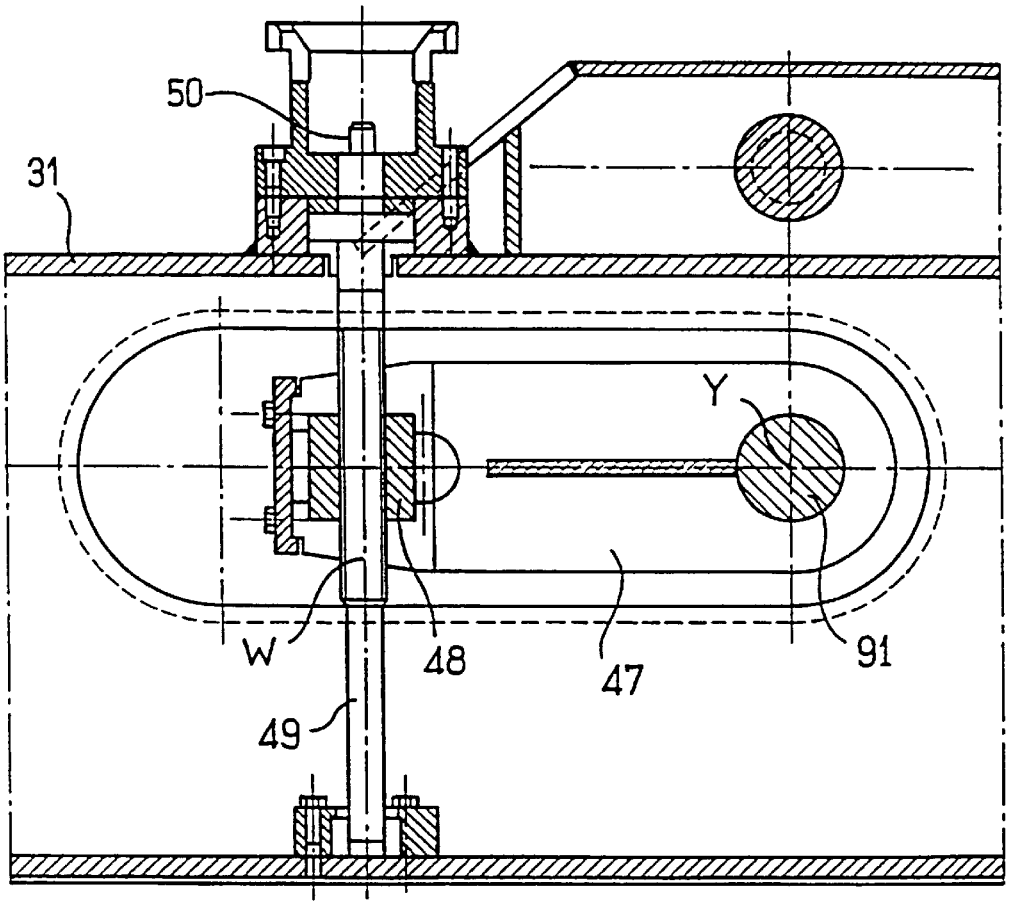
FIG. 9 is a cross-section along the sectional line IX—IX of FIG. 6.
Figure 10:
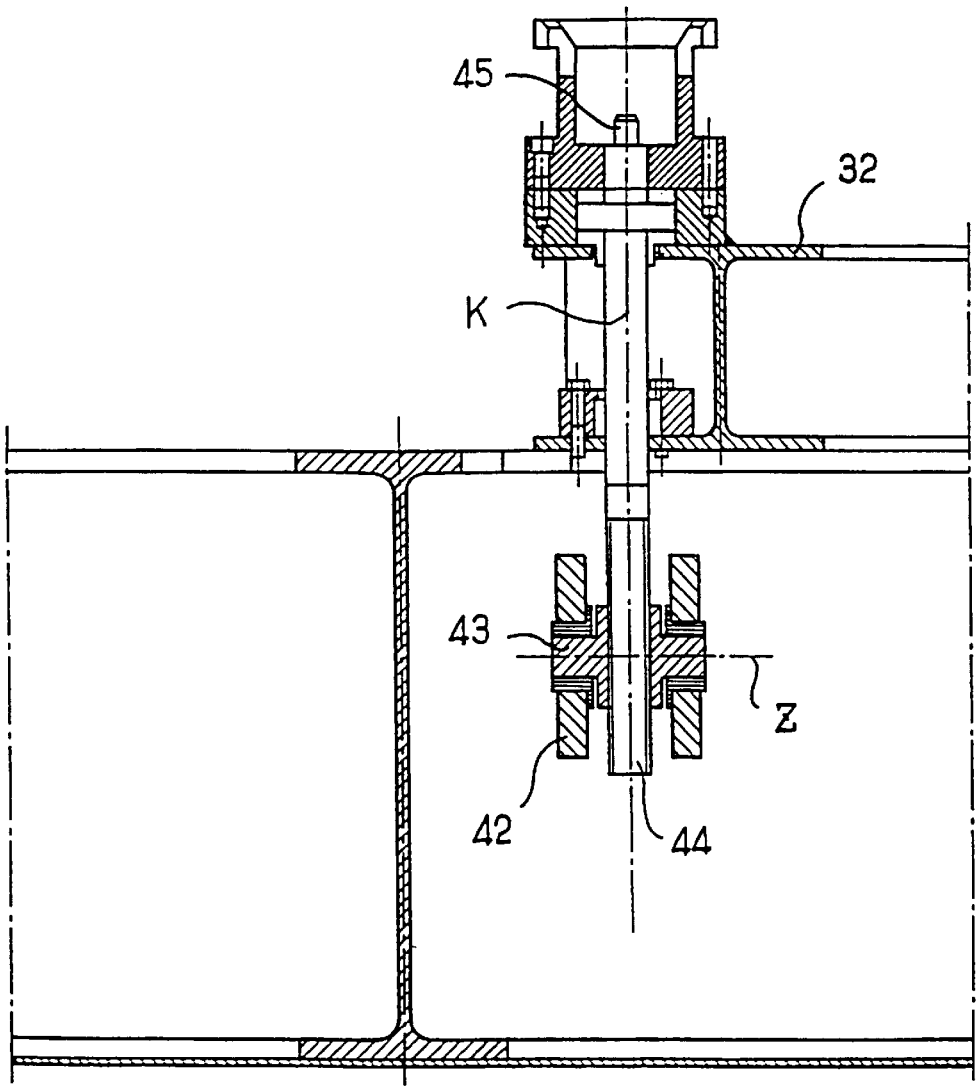
FIG. 10 is a cross-section along the sectional line X—X of FIG. 6.

The platform 32 is articulated on the frame 31 by means of a cross 33', shown in isolation in FIG. 7, comprising a tube 34 of axis X and a tube 35 of axis Y, fixed to the tube 34 by means of an assembly structure 36 located at the center of the cross.

Referring now more particularly to FIGS. 6 to 10, the platform 32 is integral, on its lower face, with a pivot 37 of axis X, engaged in one end 38 of the tube 34 and capable of pivoting in the latter about the geometric axis of rotation X.

The platform 32 is integral, on the opposite side, with a bearing 39 of axis X, capable of pivoting about a pivot 40 engaged in that end 41 of the tube 34 which is opposite the end 38. The pivot 40 is immobilized in terms of rotation in the tube 34, and it is integral, at its opposite end, with the tube 34 of a fork 42 having two parallel walls, between which a nut 43 can pivot about an axis of rotation Z parallel to the axis X.

This nut 43 is in engagement on a threaded rod 44 mounted rotatably on the platform 32 about a geometric axis of rotation K perpendicular to and secant with the axis Z.

The threaded rod 44 is equipped, at its upper end, with a wheel 45 shaped so as to be capable of being actuated in rotation by a handling robot. The rotation of the threaded rod 44 causes the nut 43 to be raised or lowered and the platform to be driven in rotation about the geometric axis of rotation X, since the pivot 40 is fixed relative to the frame 31.

The tube 35 of the cross 33' is mounted rotatably about the axis Y on the frame 31. More specifically, the tube 35 is mounted freely rotatably, at one end 46, on the frame 31 by means of a pivot 90 integral with the frame 31. The tube is integral, at the other end, with a pivot 91 supported rotatably by a bearing of the frame 31. The pivot 91 is integral, at its end opposite that engaged in the tube 35, with a fork 47 comprising two branches which carry, rotatably about an axis parallel to the axis Y, a nut 48 which is in engagement with a threaded rod 49 mounted rotatably on the frame 31 about an axis W substantially perpendicular to the plane of the frame 31. The threaded rod 49 is equipped, at its upper end, with a wheel 50 shaped so as to be driven in rotation by a handling robot. The rotation of the rod 49 causes the nut 48 to be raised or lowered and the platform 32 to pivot about the axis Y.

Figure 6:
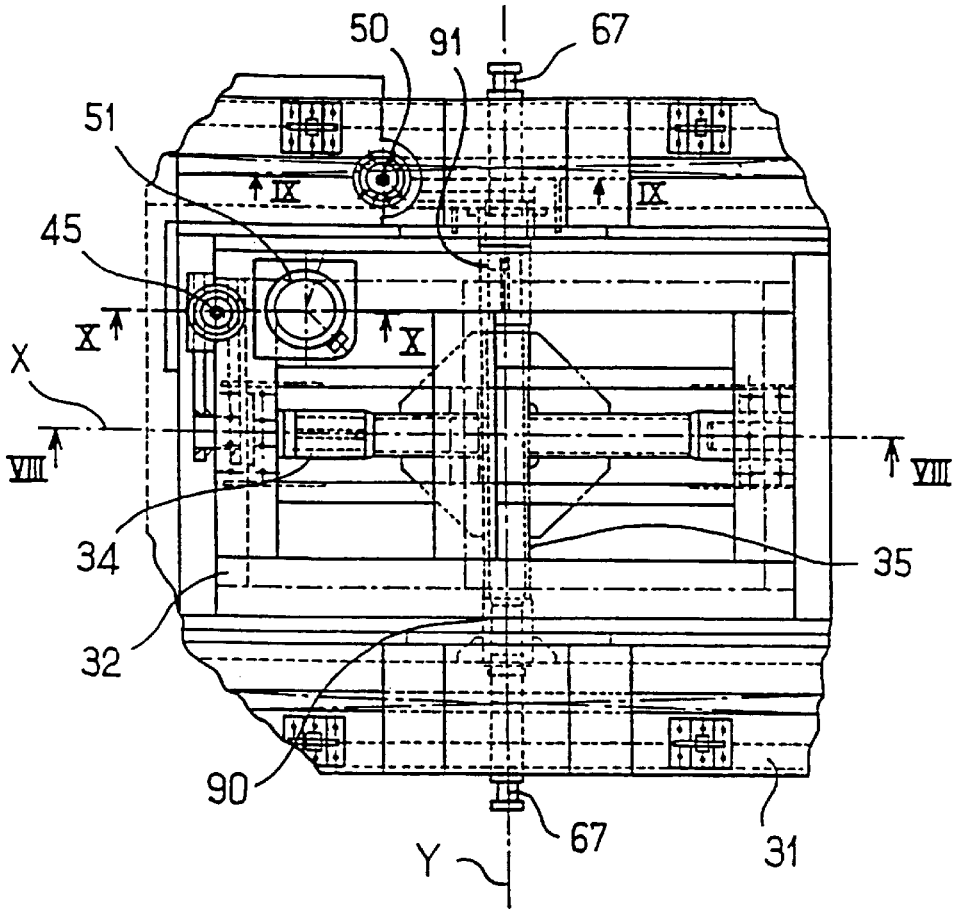
FIG. 6 is a diagrammatic top view of the manifold support platform carried by the frame of the mounting plate illustrated in FIGS. 2 to 5.

A spirit level 51 is fixed to the upper face of the platform 32, in order to make it possible to position the platform 32 horizontally, with the axis H of the flange 11 substantially vertical, as illustrated in FIG. 6.

Thus, after the mounting plate 6 or 8 has been installed, it is possible to change the orientation of the connecting flange 11 before attaching to the latter the union which equips the end of the pipe 12.

If the ocean bed, on which the mounting plate 6 or 8 is installed, is inclined, the joining plane of the flange 11 can thus be positioned substantially horizontally, the axis H of the flange then being substantially vertical, with the exception of the tolerances permitted for connection to the pipe 12. The latter is advantageously equipped with a union comprising a locking member capable of coming into the locking position as a result of the effect of gravity, in which case it is especially important that the joining plane of the flange 11 should be as horizontal as possible. In the exemplary embodiment described, the platform 32 can be pivoted through approximately 10° about each axis X and Y, and the verticality of the axis H of the flange 11 can be ensured, with an angular tolerance better than 5°, preferably better than 3°.

Figure 11:
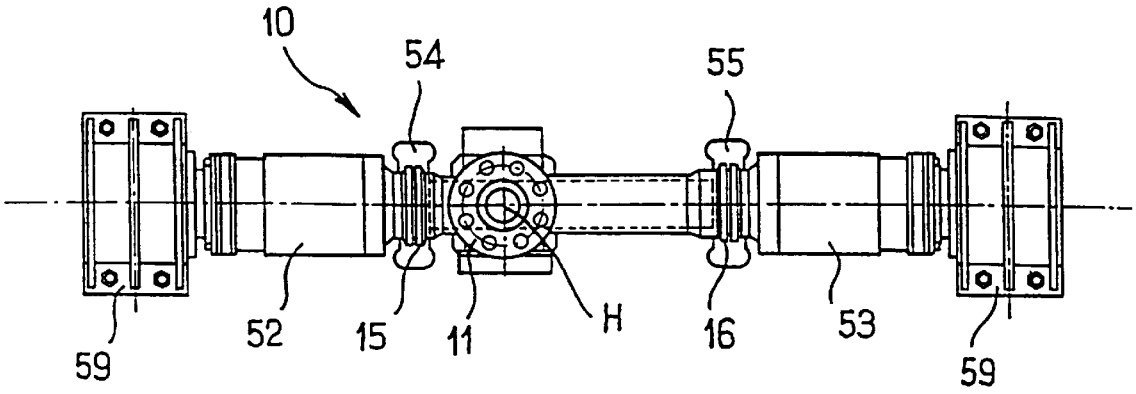
FIG. 11 is a diagrammatic top view of the manifold carried by the mounting plate illustrated in FIG. 2, only the joining pieces of the flexible pipes being illustrated.

FIG. 11 illustrates the manifold 10 in a top view.

The joining pieces of the terminal parts 17 and 18 of the flexible pipe sections 5 and 7 have been designated by 52 and 53.

The joining pieces 52 and 53 and the flanges 15 and 16 are connected by means of joints 54 and 55 of the type known per se by the name of "Grayloc".

So as to avoid excessive curvature of the terminal portion 17 and 18 of the flexible pipes, these portions are each engaged in curvature limiting members which, in the example described, consist of an assembly 56 of vertebrae.

These vertebrae are not illustrated in FIG. 11 for the sake of clarity in the drawing.

Figure 12:
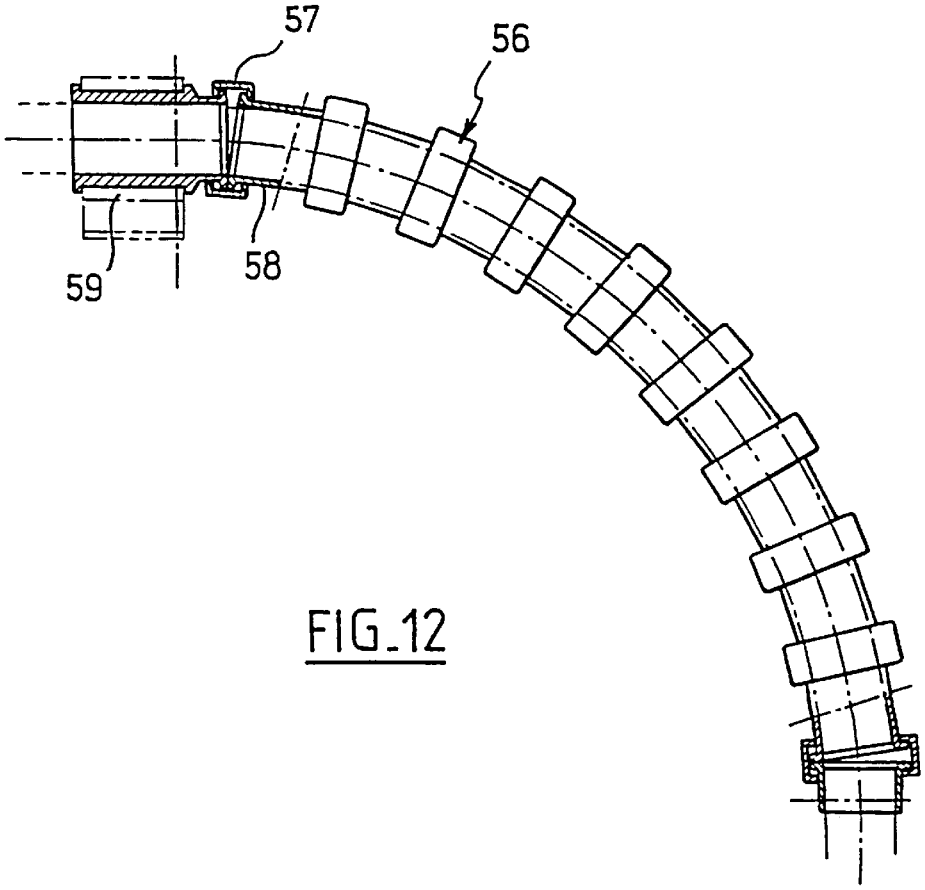
FIG. 12 is a diagrammatic view illustrating an assembly of vertebrae.

FIG. 12 illustrates an assembly 56 of vertebrae, which is formed by assembling in a way known per se vertebrae 57 and 58 which have a symmetrical form of revolution and which consist of tubular elements having, in a section taken in a plane containing their axis of symmetry, a U-shape with edges turned inwards, as regards the vertebrae 57, or with edges turned outwards, as regards the vertebrae 58, two vertebrae 58 being assembled together by means of a vertebra 57.

The terminal portion of each flexible pipe section engaged in an assembly of vertebrae 56 is free to slide within the latter. Each assembly of vertebrae 56 is fixed, at its end adjacent to the manifold 10, to the platform 32 by means of a collar 59. Thus, the bending forces are absorbed by the assemblies 56 of vertebrae fixed to the platform, and the T-union is not subjected to high stresses which would otherwise be liable to damage the joints of the "Grayloc" type or the union itself.

Figure 13:
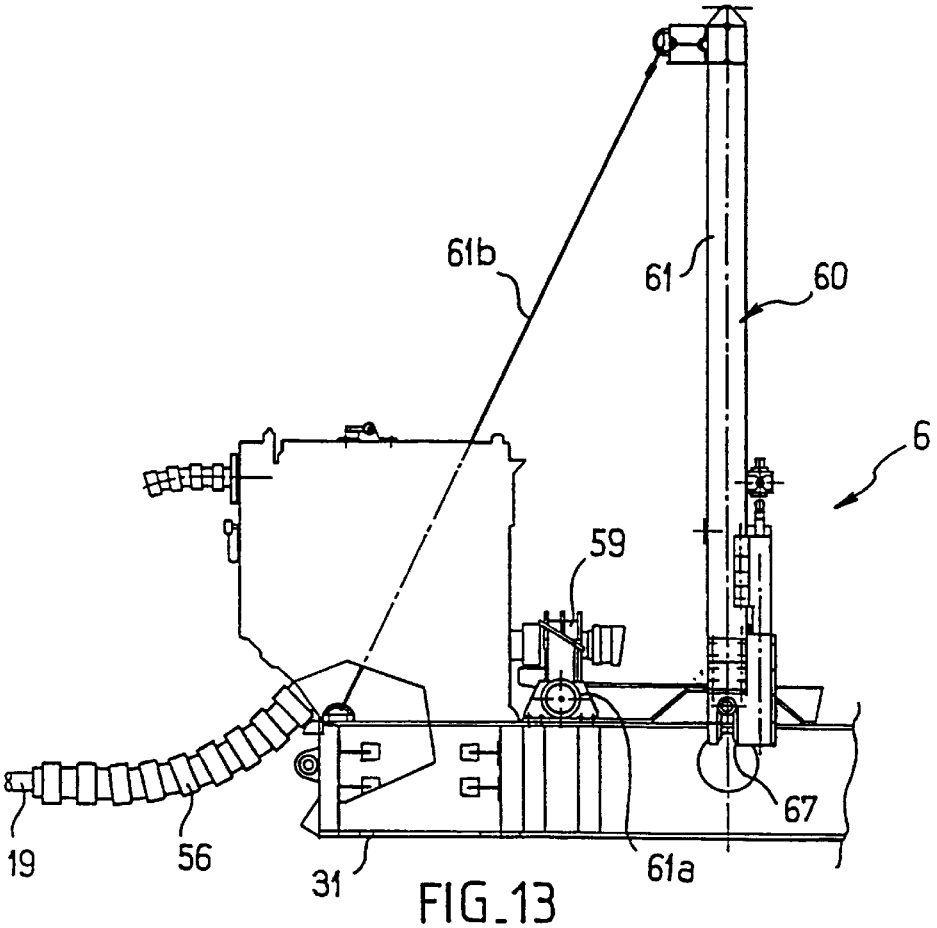
FIG. 13 is a diagrammatic side elevation view illustrating a gantry used for installing a mounting plate.
Figure 14:
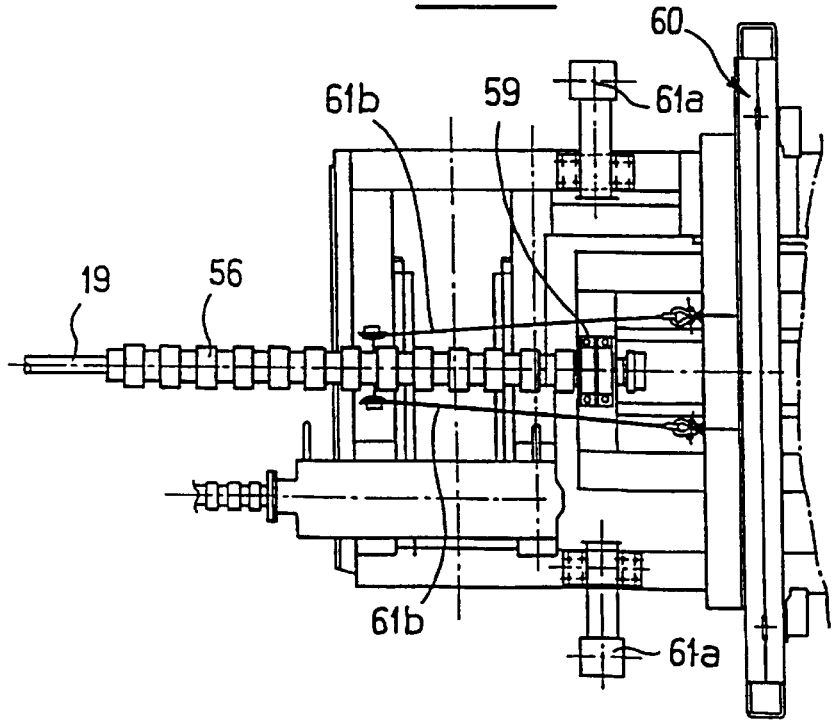
FIG. 14 is a top view of the gantry illustrated in FIG. 13.
Figure 15:
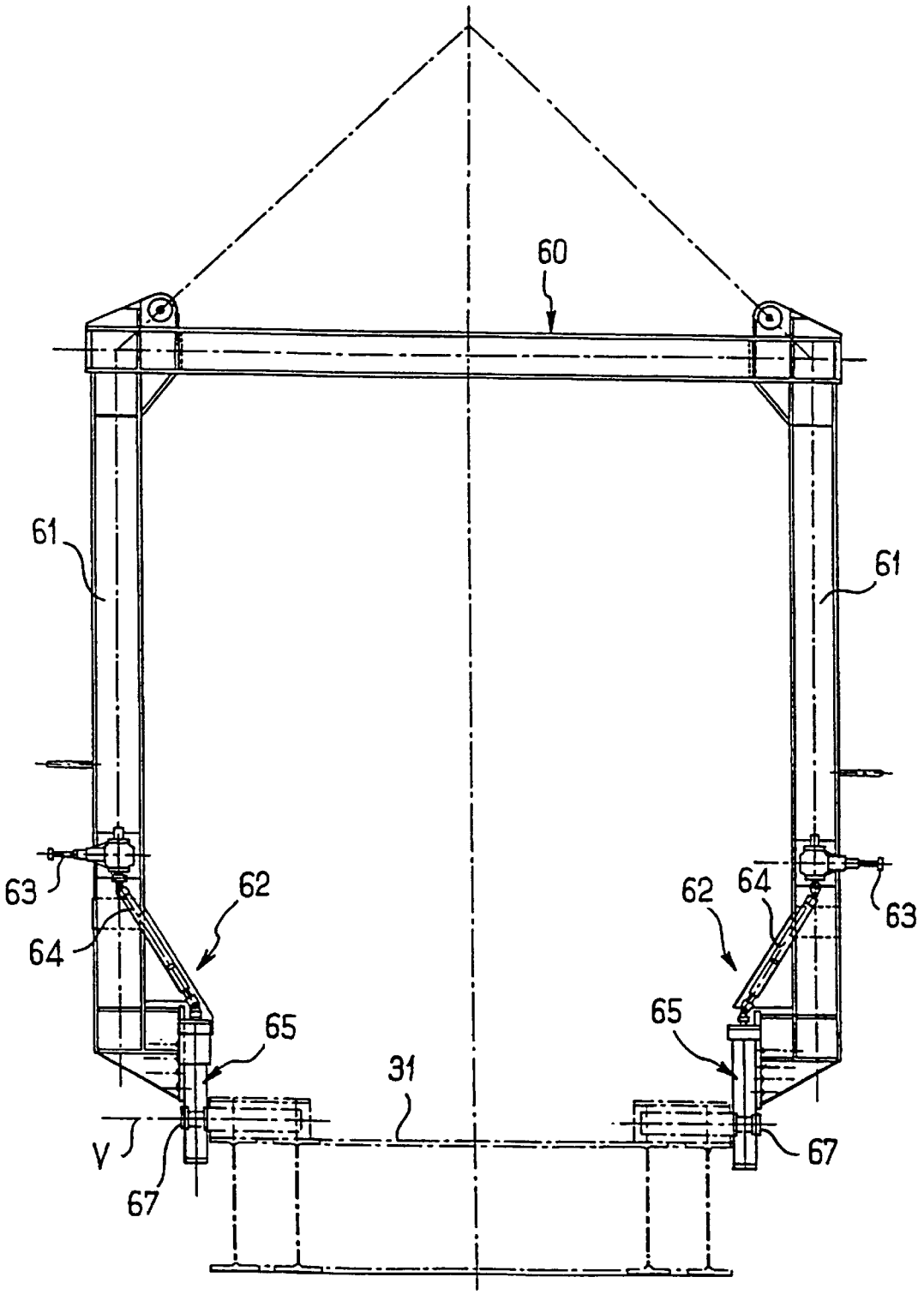
FIG. 15 is a front elevation view of the gantry illustrated in FIG. 13.

FIGS. 13 to 15 illustrate a gantry 60 used during the installation of a mounting plate 6 or 8, as described later.

This gantry 60 comprises a rigid U-shaped framework, the uprights 61 of which are fixed pivotably to the frame 31 about a geometric axis of rotation V parallel to the geometric axis Y. More specifically, each upright 61 is fixed removably, at its lower end, to the frame 31 by means of a locking mechanism 62 comprising a rotary member 63 mounted rotatably on the upright 61 and connected to a mechanism 65 by means of a cardan-joint transmission 64. This mechanism 65 makes it possible to actuate a hook 66 coming into engagement on the end 67 of a pin fixed to the frame 31, in order to retain the gantry 60 on the frame 31, whilst allowing it to rotate.

The angular deflection of the frame is limited, as regards the mounting plate 8, by stops 61*a* arranged on one side of the axis Y and by cables 61*b* connecting the crosshead of the gantry 60 and the frame 31, these cables 61*b* being attached in the vicinity of the free edge of the frame 31 on the same side as the stops 61*a*. The cables 61*b* are tensioned when the gantry is arranged substantially perpendicularly to the plane of the frame 31. The cables 61*b* make it possible to keep the gantry substantially perpendicular to the mounting plate, even when the center of gravity of the latter is not in the vertical half-plane delimited upwards by the geometric axis of rotation of the gantry. The mounting plate 6, which comprises two supports 33 of connecting housings for control umbilicals, is better balanced than the mounting plate 8, and the angular deflection of the frame is limited by stops 61*a* arranged either side of the axis Y.

Figure 16:
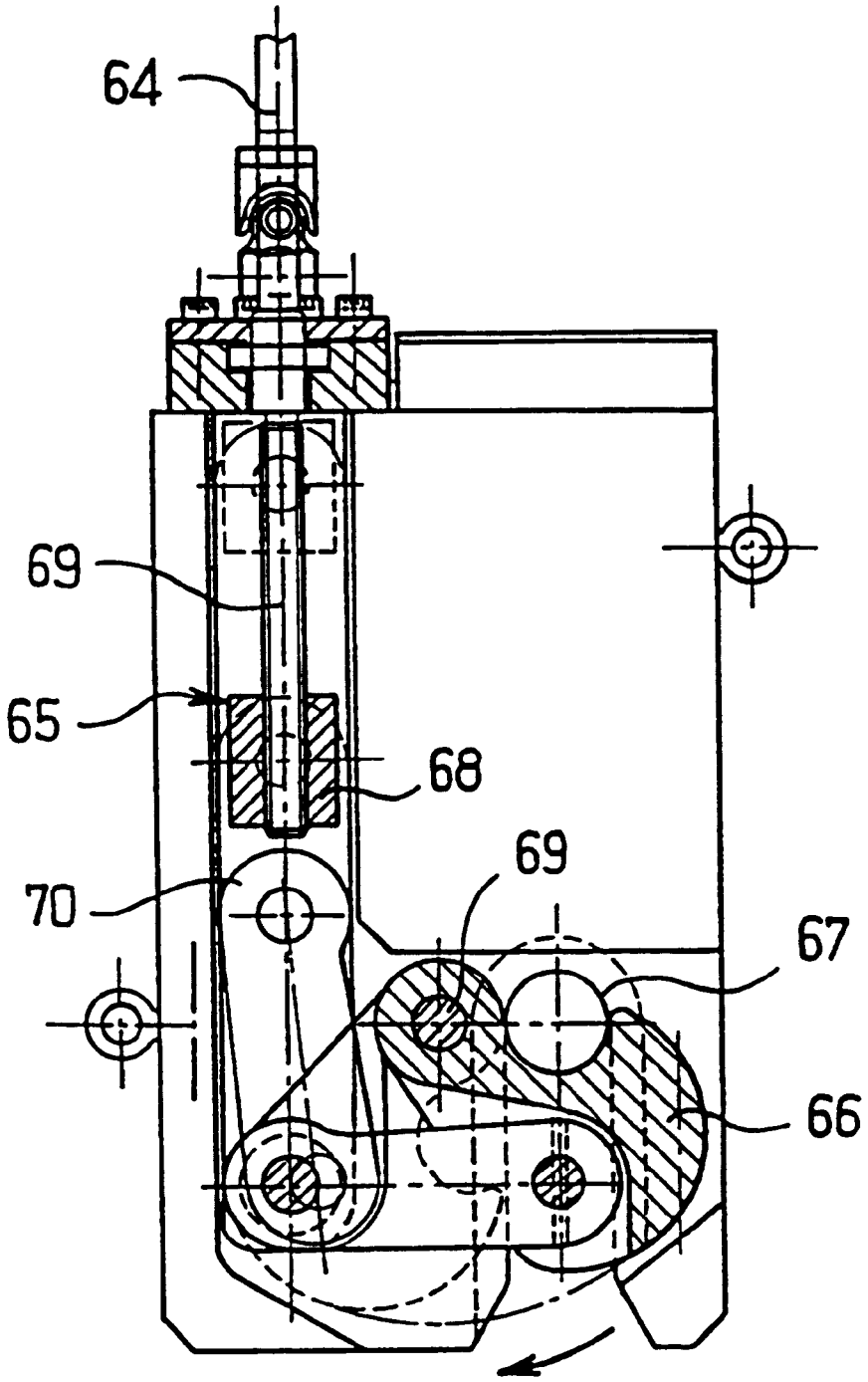
FIG. 16 illustrates a detail of the mechanism for fixing the gantry removably to the mounting plate.
Figure 17:
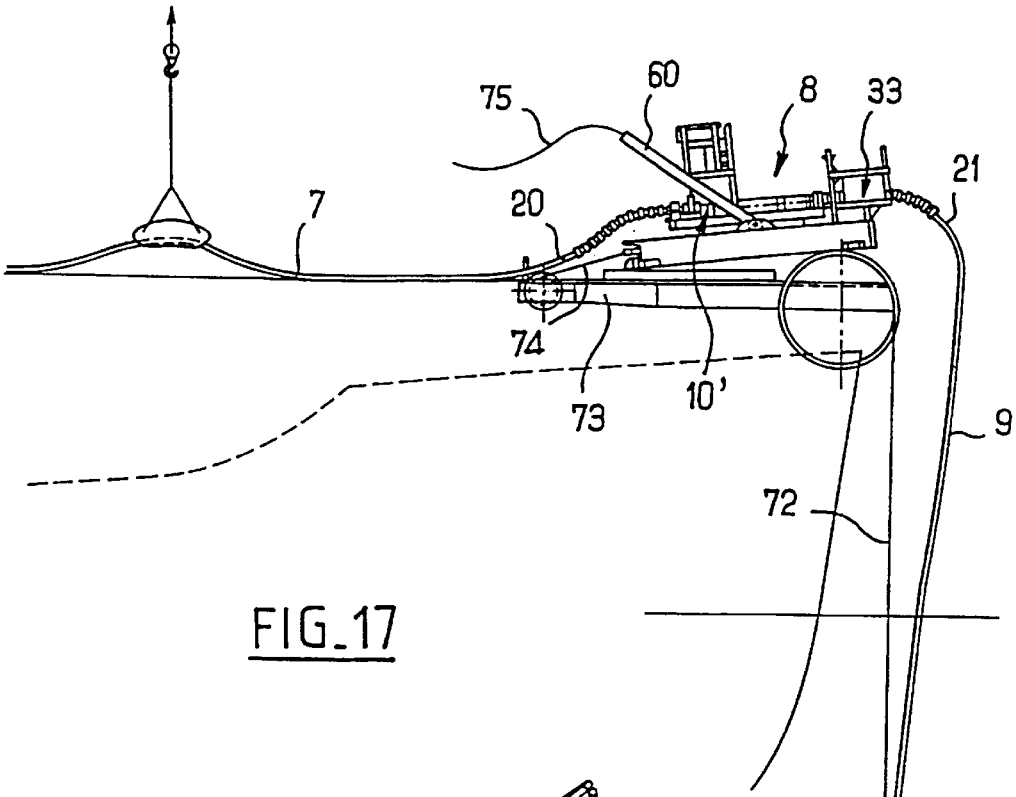
FIGS. 17 to 21 illustrate various steps in the installation of a mounting plate.

The mechanism 65 comprises a nut 68 in engagement on a threaded rod 69 driven in rotation by the transmission 64. The nut 68 is articulated, about an axis parallel to the axis V, on one end 70 of a link connected to the hook 66 which is itself articulated at 69 about an axis of rotation parallel to the axis V. The rotation of the member 63 gives rise, by means of the transmission 64, to the rotation of the threaded rod 69 and the raising of the nut 68 which drives the hook 66 in downward pivoting about the axis of articulation 69. The pivoting of the hook 66 makes it possible to free the end 67, as illustrated in FIG. 16. In this figure, broken lines illustrate the position of the hook 66 at the end of pivoting after the nut 68 has been raised. Conversely, the gantry 60 can make it possible to recover a mounting plate placed on the ocean bed.

The method of installing the installation 1 described above will now be described with reference to FIGS. 17 to 21.

First of all, a first flexible pipe section, for example the section 9, is unwound. When the vicinity of the end of this section is reached, the tension attributable to the weight of the submerged part of the flexible pipe is absorbed by means of a sleeve clamped on the flexible pipe and also called "Chinese finger" or "thimble", fixed to a cable 72 wound on a winch.

The mounting plate 8 can then be brought to the rear of the installation ship on an inclinable ramp 73. The respective terminal portions 21 and 20 of the flexible pipe sections 9 and 7 are fixed to the manifold 10' mounted on the mounting plate 8. The gantry 60 rests on the rear stops 61*a*. The frame 31 of the mounting plate 8 is fixed at the rear to a first cable 74 wound on a winch, and the gantry 60 is fixed by means of its crosshead to two slings connected to a second cable 75 which is likewise wound on a winch.

Before the ramp 73 is tilted, care is taken to ensure that there is slack in the portion of flexible pipe 9 located above the thimble 71.

Figure 18:
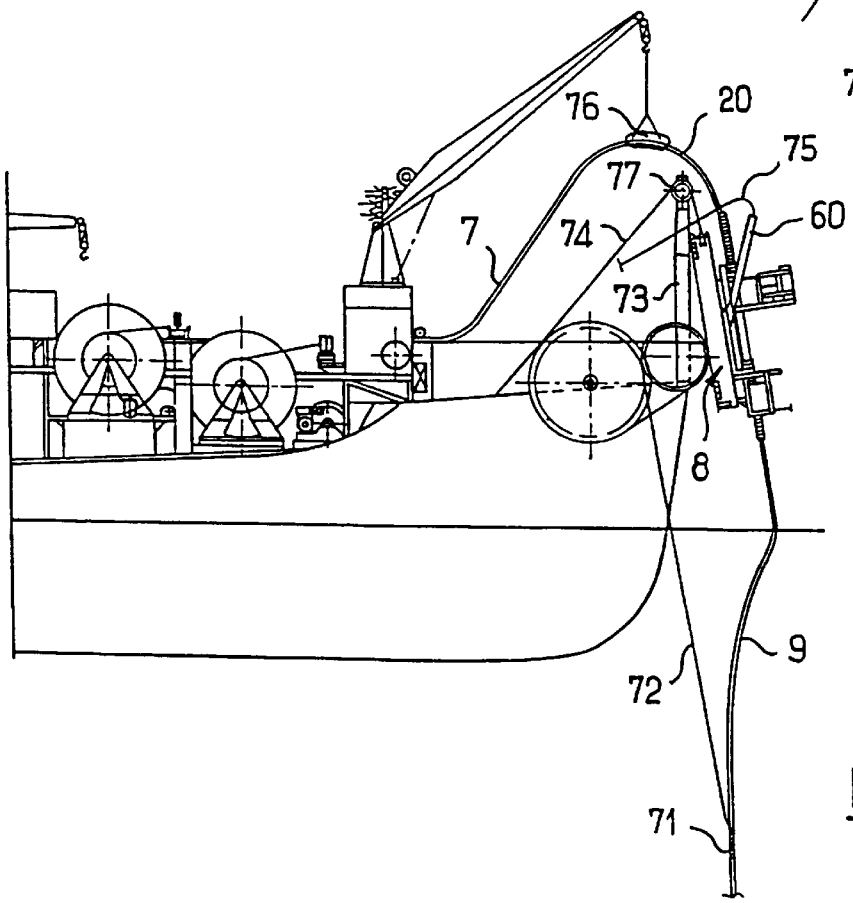

The ramp 73 is subsequently tilted, as illustrated in FIG. 18. The thimble 71 supporting the pipe 9 makes it possible to avoid the occurrence of bending movements which would otherwise be liable to damage the connection between the pipe 9 and the manifold 10'.

The terminal portion 20 of the flexible pipe is held by means of a stringer 76 suspended by a crane, in order to minimize the bending movements exerted on the ends of the flexible pipes. The ramp 73 is equipped, in the upper part, with a guide pulley 77, over which passes the cable 74 which supports the mounting plate 8 when the latter is progressively lowered into the water in a substantially vertical position. The cable 74 absorbs virtually the entire weight of the mounting plate 8 while the latter is being put into the water.

Figure 19:
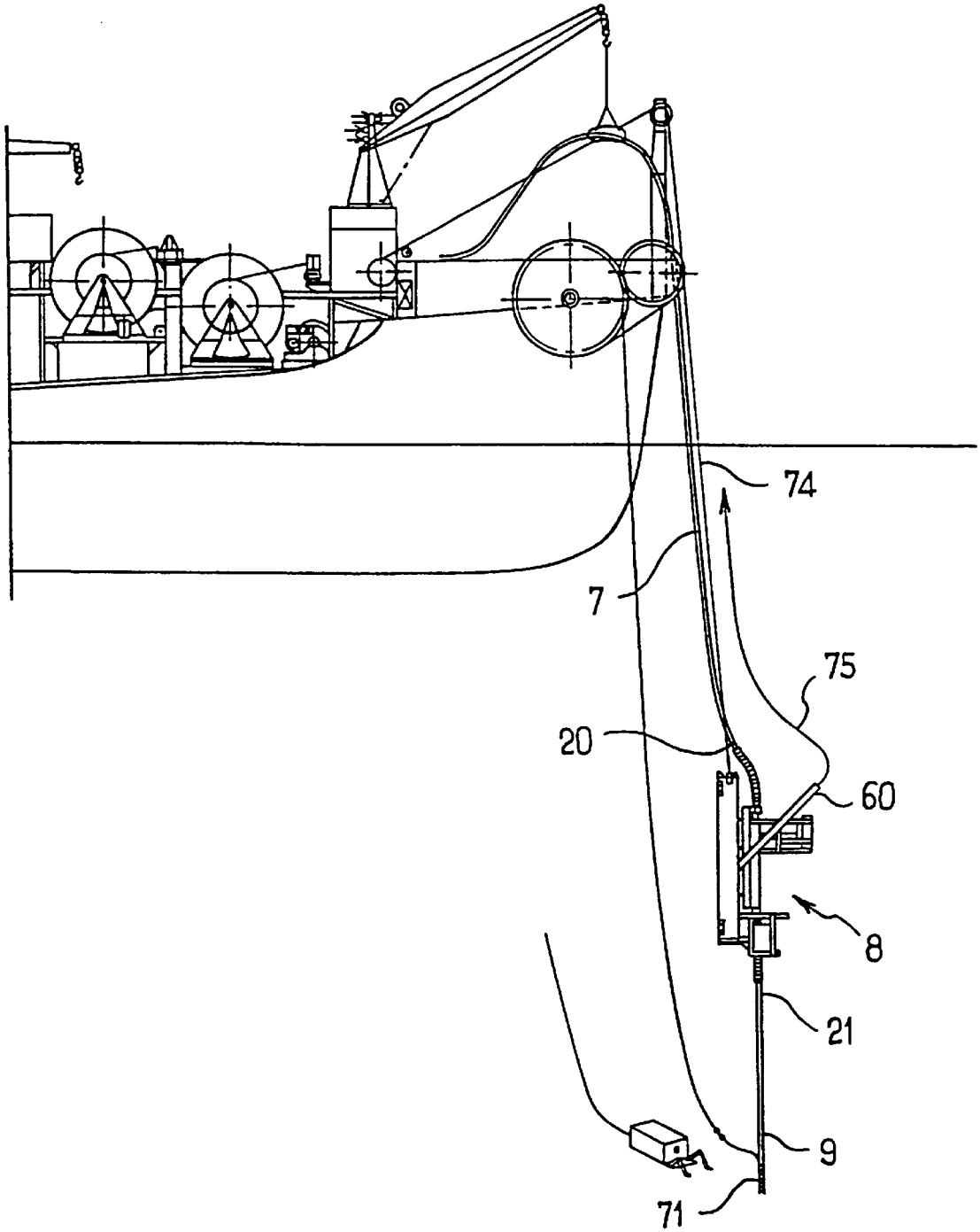

The mounting plate 8 is subsequently lowered into the water, and when it reaches a depth of a few tens of meters, the thimble 71 is detached with the aid of a handling robot (R.O.V), as illustrated in FIG. 19. The cable 75 connected to the gantry 60 is not tensioned. The weight of the mounting plate 8 and of the flexible pipe section located under the latter is absorbed by the cable 74.

Figure 20:
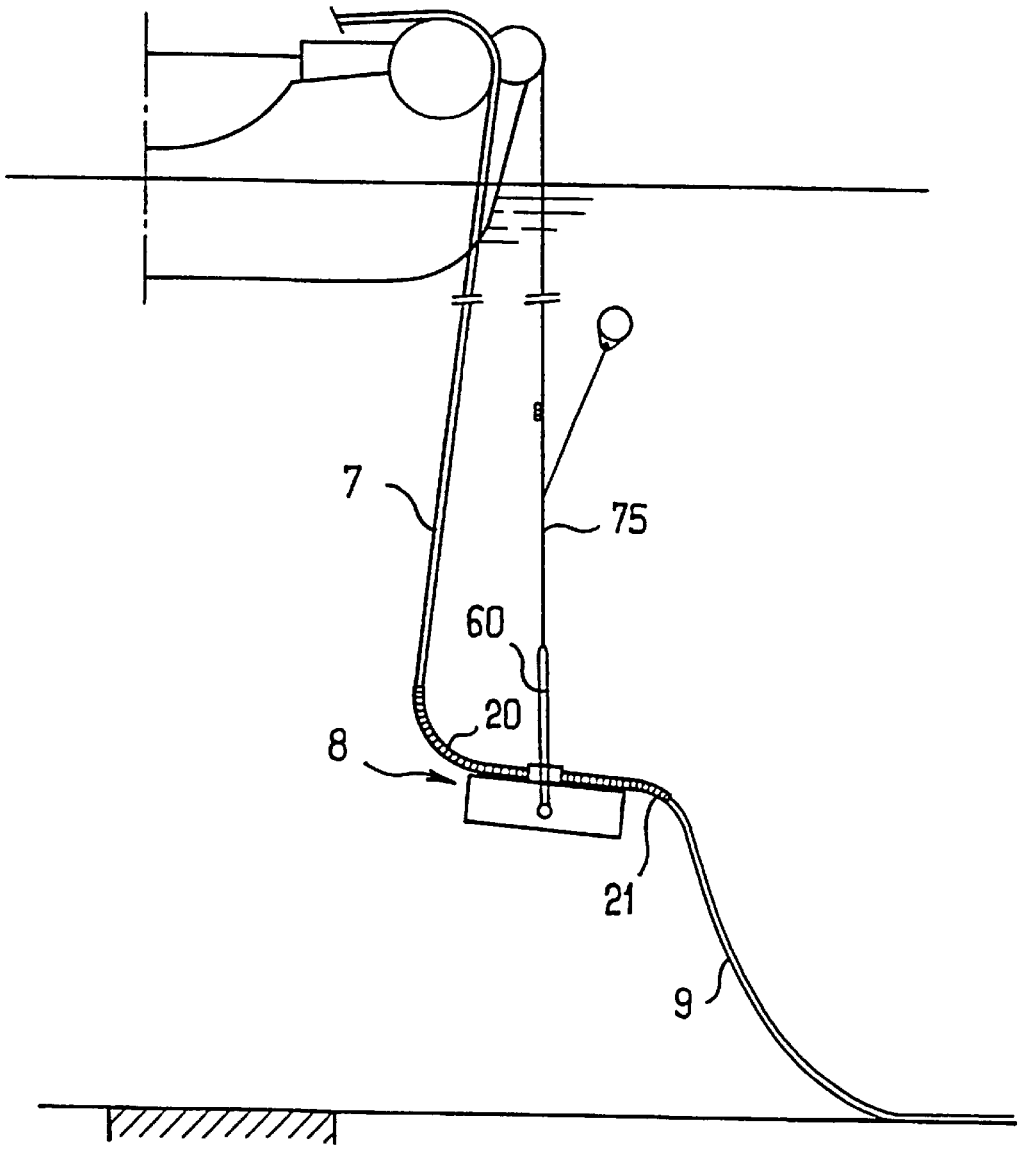

A progressive tilting of the mounting plate 8 in order to bring it into a horizontal position is subsequently carried out. For this purpose, the tension of the cable 74 is progressively reduced by increasing that of the cable 75, and, when the latter is tensioned, the cable 74 is detached by means of a handling robot. The configuration of FIG. 20 is then assumed, the mounting plate 8 being located at a height of approximately 10 meters from the bed. In this figure, hatching illustrates the location at which the mounting plate 8 is to be deposited.

Figure 21:
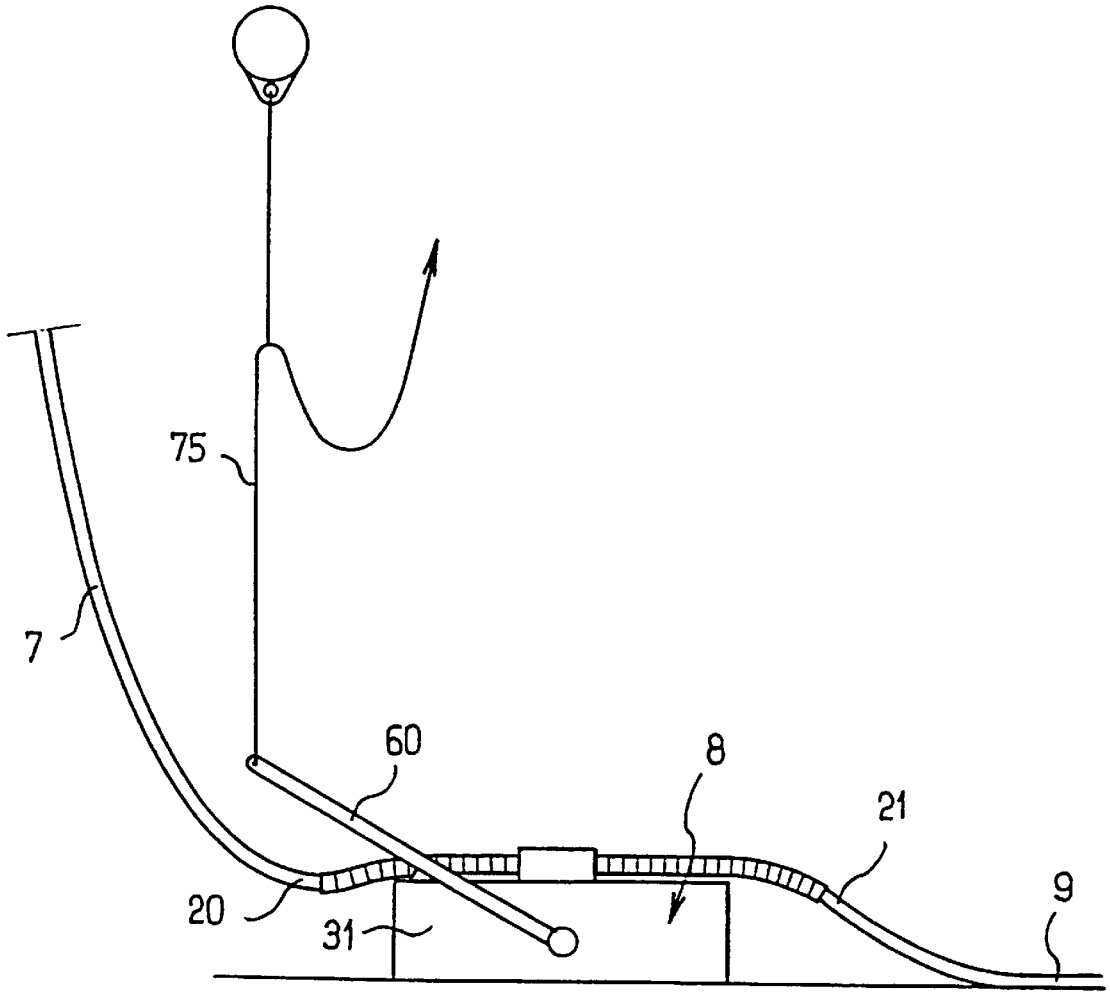

After the mounting plate 8 has been placed on the ocean bed, the cable 75 is given slack, before the gantry 60 is detached from the frame 31 of the mounting plate 8, as illustrated in FIG. 21.

In order to detach the gantry 60, the rotary members 63 are rotated by means of a handling robot, so as to release the hooks 66 from the ends 67. Owing to the distance separating the rotary members 63 from the ocean bed, the rotary members 63, when being actuated, are located at a sufficient height above the ocean bed to ensure that the possible clouds of particles raised by the propellers of the handling robot do not obstruct the visibility of the latter.

After the gantry 60 has been detached, it is recovered and put in place on the mounting plate 6 which is installed in a similar way.

In order to carry out correctly the installation of the sections 5, 7 and 9 and the mounting plates 6 and 8, the installation ship has described a loop without having to move in reverse. Proceeding in the opposite direction, that is to say installing the section 5 first, does not depart from the scope of the invention.

Figure 22:
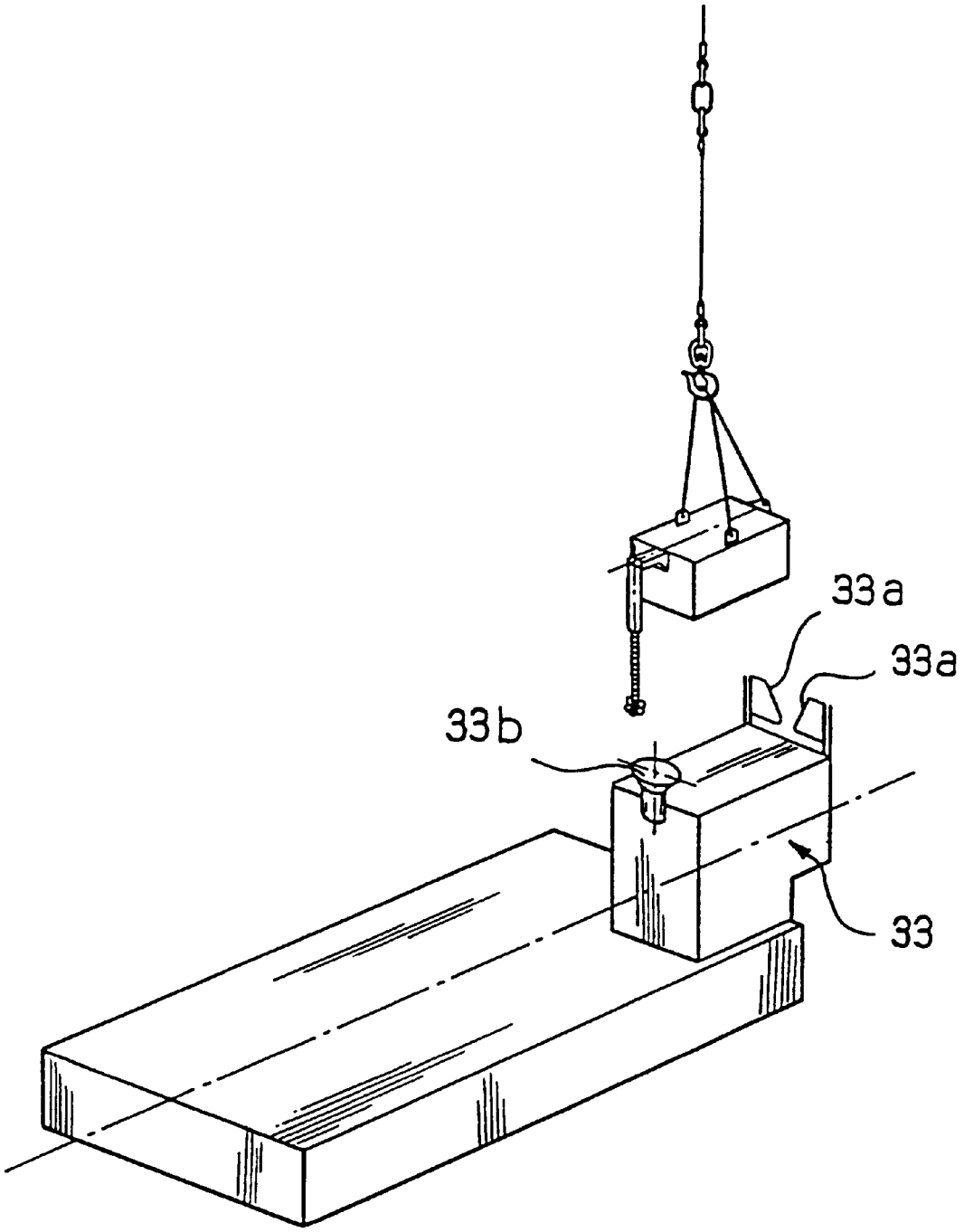
FIG. 22 illustrates the installation of a housing for the connection of control umbilicals on a connecting housing support fixed to a mounting plate.

In order to carry out the installation of the connecting housings for the control umbilicals, the connecting housing is brought, at the end of a cable, above the corresponding support, and a chain is engaged in the guide 33*b* of the latter, the said chain extending downwards the associated centring spindle, as illustrated in FIG. 22.

After the connecting housings have been installed, the operations to connect the umbilicals to one another are carried out with the aid of a handling robot.

Before the flange 11 is connected to the associated pipe 12, the orientation of the axis H of the flange 11 is corrected, if necessary, by rotating the wheels 45 and 50 with the aid of a handling robot. The spirit level 51, which gives information on the horizontality of the platform 32, is observed by means of a camera located on the handling robot.

Figure 5:
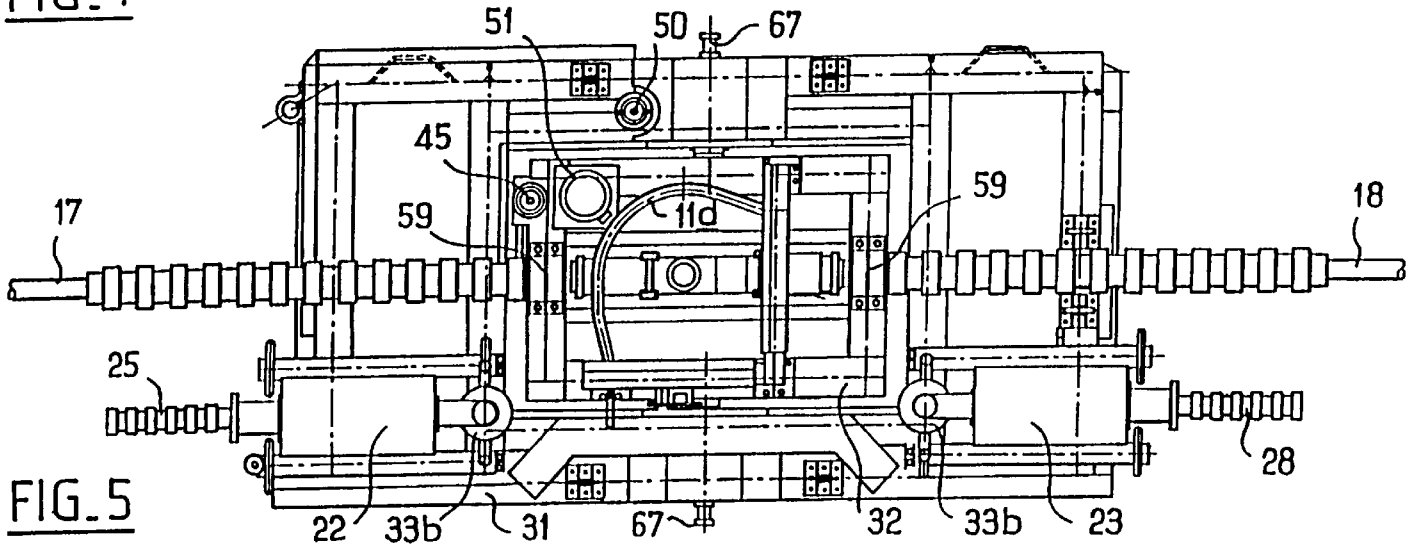
FIG. 5 is a top view of the mounting plate illustrated in FIG. 4.

It will be seen from an examination of FIG. 2, in particular, that the flange 11 is located at the bottom of a guide structure comprising two panels 11*a*, 11*b* serving for positioning the union equipping the pipe 12 before the said union is lowered onto the flange 11. A guide 11*c* allows the passage of a cable used in order, if necessary, to lay the said union against the panels 11*a* and 11*b* before it is lowered onto the flange 11. It will be seen from FIG. 5 that the panels 11*a* and 11*b* are connected by means of a bow 11*d* which does not impede the access of the handling robot to the flange 11 and to the wheels 45 and 50 and which allows the handling robot to see the spirit level 51.

Of course, the invention is not limited to the exemplary embodiment which has just been described.

It would be possible, in particular, in an alternative embodiment not illustrated, to mount the platform 32 on three feet which are arranged as the vertices of a triangle on the frame 31 and the height of which would be adjustable, so as to make it possible to position the platform at a selected orientation relative to the frame.

It would also be possible, in another variant not illustrated, to fix to the frame the manifold for connecting the flexible pipes and pipe coming from the wellhead, simply by mounting the flange for connecting the pipe coming from the underwater well on an orientable joint of the ball-and-socket joint type, which would be positioned with the desired orientation by means of a handling robot, before the connection is made.

What is claimed is:

1. An offshore oil extracting installation comprising a first and a second separated mounting plates, each mounting plate for resting on the ocean bed;

a first manifold supported to adjustably tilt on the first mounting plate and a second manifold supported to adjustably tilt on the second mounting plate; each manifold having respective first and second ends;

a respective flange on each of the first and second manifolds for sealed connection to a respective pipe coming from an underwater structure, each flange having a longitudinal axis which extends in a direction in relation to the plate which direction is reorientable with the adjustment of the manifold;

a flexible first pipe section connected between the first ends of the first and second manifolds connecting the first and second manifolds; respective second pipe sections each having a first end connected to the respective second end of one of the manifolds, and each second pipe section having a second end that is connectible to a surface extracting installation.

2. The installation of claim 1, wherein each pipe section includes a terminal joining piece to be fixed to the respective end of the manifold to which the pipe section is connected.

3. The installation of claim 1, wherein the second flexible pipe sections have respective portions which are joined to the respective ones of the first and second manifolds, and a respective curvature limiting member being attached to the mounting plate at the portions of the second flexible pipe sections near the respective manifolds for limiting the curvature of the portions of the flexible pipe sections.

4. The installation of claim 3, wherein each curvature limiting member is comprised of an assembly of vertebrae and one end of the assembly is fixed to the mounting plate; and the portion of each second pipe section extends inside the respective curvature limiting member vertebrae and is slidable therein.

5. The installation of claim 1, wherein each of the manifolds is generally T-shaped, and the flange for connection to a pipe coming from an underwater structure is connected to the central branch of the T.

6. The installation of claim 1, further comprising a valve on one of the first and second mounting plates and so connected with the first and second manifolds as to enable the first and second manifolds on the two mounting plates to be selectively placed in communication or isolated.

7. The installation of claim 6, further comprising a network of lines for remote control of the mounting plates and the installation, the network comprising pipes of the umbilical type comprising a first umbilical connecting the surface extracting installation and the first mounting plate and a second umbilical connecting the first mounting plate to the second mounting plate.

8. A manifold support mounting plate for use in an oil extracting installation wherein the mounting plate is intended for resting on the ocean bed, the mounting plate comprising:

a plate;

a manifold adjustable supported on the plate to tilt; the manifold including:

a first connection for connecting to a terminal part of at least one flexible pipe section;

a flange on the manifold, the flange having a longitudinal axis which extends in a direction in relation to the plate which direction is reorientable with the adjustment of the manifold for making a sealed second connection to a pipe coming from an underwater structure.

9. The manifold support mounting plate of claim 8, further comprising the pipe coming from the underwater structure, the pipe including a union comprising a locking member joinable to the flange and which is adapted into a locking position under the influence of gravity, and the selected direction of orientation of the flange corresponds to the vertical direction for the pipe with an angular tolerance of at most 10°.

10. The manifold support mounting plate of claim 9, wherein the angular tolerance is at most 5°.

11. The manifold support mounting plate of claim 8, wherein the plate comprises a fixed frame resting on the ocean bed and a platform connected to the fixed frame and orientatable relative to the frame to a selected orientation; and the manifold being fixed to the platform for being oriented together with the platform.

12. The manifold support mounting plate of claim 11, further comprising a cardan-type joint connecting the platform to the frame.

13. The manifold support mounting plate of claim 11, further comprising means for orienting and maintaining the flange in the selected direction.

14. The manifold supporting plate of claim 8, further comprising means for orienting and maintaining the flange in the selected direction.

15. The manifold support mounting plate of claim 8, comprising means on the plate for removably fixing a gantry to the plate such that the gantry may be used for installing the mounting plate on the ocean bed and for recovering the mounting plate.

16. The manifold support mounting plate of claim 15, including the gantry which is removably fixable to the means for fixing the gantry to the plate.

17. The manifold support mounting plate of claim 16, wherein the gantry comprises at least one rotary actuation member actuatable by a handling robot, a hook on the gantry operable by the rotary actuation member for fixing the gantry to the mounting plate and a transmission and the mechanism connected with the transmission and capable of converting the rotation of the rotary member into movement for locking or unlocking the hook.

* * * * *